United States Patent [19]

Noe et al.

[11] Patent Number: 4,886,199

[45] Date of Patent: Dec. 12, 1989

[54] STRIP DRIVE FOR ADVANCING MATERIALS FOR PROCESSING

[75] Inventors: Oskar Noe; Rolf Noe; Andreas Noe, all of Mülheim; Willi Dötsch, Oberhausen; Herbert Lux, Mülheim, all of Fed. Rep. of Germany

[73] Assignee: Bergwerk-und Walzwerk-Maschinenbau GmbH, Duisburg, Fed. Rep. of Germany

[21] Appl. No.: 216,871

[22] Filed: Jul. 8, 1988

[30] Foreign Application Priority Data

Jul. 10, 1987 [DE] Fed. Rep. of Germany ..... 3722783
Dec. 23, 1987 [DE] Fed. Rep. of Germany ..... 3743763

[51] Int. Cl.[4] ..... B65H 20/24
[52] U.S. Cl. ..... 226/118; 226/119
[58] Field of Search ..... 226/118, 119; 242/47.5, 242/55.01

[56] References Cited

U.S. PATENT DOCUMENTS 4,060,186 11/1977 Nabhan ..... 226/118
4,071,178 1/1978 Copp ..... 226/119 X
4,281,784 8/1981 McMullen ..... 226/118
4,360,137 11/1982 Noe et al. ..... 226/119 X

*Primary Examiner*—John Petrakes
*Assistant Examiner*—Phillip S. Han
*Attorney, Agent, or Firm*—McGlew & Tuttle

[57] ABSTRACT

A strip treatment apparatus, for example for metal strips includes a strip drive and a strip store disposed both at the apparatus entry and apparatus exit with a processing section being disposed between the two stores and a strip drive being disposed after the processing section. The two loop trolleys or roll tables of the strip stores are mechanically interconnected to form a movable unit. The strip drive disposed after the processing section and/or the strip drives at the entry and exit of the apparatus are operative as drives for moving the interconnected loop trolleys or interconnected roll tables, so that independent drives for these movable units can be omitted.

20 Claims, 7 Drawing Sheets

STRIP DRIVE FOR ADVANCING MATERIALS FOR PROCESSING

FIELD AND BACKGROUND OF THE INVENTION

This invention relates in general to drives operated with continuous strips and in particular to a new and useful strip drive for advancing materials for processing.

The invention relates particularly to an apparatus for treating strips of metal, plastics, paper or the like with a strip drive and a strip store being disposed at the apparatus entry and apparatus exit. A processing section is disposed between the two stores and a strip drive is disposed after each section. The strip stôres comprises a horizontally movable loop trolley or a roll table movable vertically in a loop tower.

A strip store for bridging pauses during the changing of coils or windings or reels must be provided at the entry and exit of apparatus for heating strips, for example, of metal, plastics, paper and foils. The processing section for treating metal strips may be a rolling mill or a stretching apparatus or a pickling bath or a heat treatment facility or a galvanizing plant or color coating plant or the like. Horizontal and vertical strip stores are known. Horizontal strip stores usually have two loop trolleys, each of which have an independent tension-controlled drive. Each trolley drive is connected to the associated loop trolley by way of a cable and has the sole function of keeping the set-up strip tension very constant during filling and emptying of the store in order to obviate irregular strip treatment and, therefore, impairments of quality. The drives for the loop trolleys used in the treatment of metal strips are designed for cable tensions of from 10 to 30 tons and require elaborate control facilities for the eable tensions. It must also be possible to maintain cable tension during prolonged stoppage times of the trolleys. This requirement calls, for example, for the use of special electric motors having heat exchangers or dual drives. Trolley drives of this kind are very expensive and their installation and servicing are complex. Similar considerations apply to the space they require and to repair work on them. Circumstances are similar for vertical strip stores which are of use more particularly for storing long lengths of strip. The vertical type has a stationary roll carrier and a vertically movable roll table. Associated therewith is a table drive which moves the table up or down with a tension adjustable to suit the required strip tension.

SUMMARY OF THE INVENTION

The invention provides an apparatus for treating strips of materials such as metal, plastics, paper, or the like, whose strip stores are of very simple and operationally satisfactory construction and which considerably reduces space requirements and costs.

According to the invention, therefore, in a strip treatment apparatus two loop trolleys, or the two roll tables which independently of the strip looping through them, are mechanically interconnected to form a movable unit. A strip drive is disposed after the processing section and/or strip dries are provided at the entry and exit and are operative as drives for moving the interconnected loop trolleys or interconnected roll tables. According to the teaching of the invention, therefore, individual trolley drives or table drives for the trolleys or tables are omitted, the trolleys or tables being moved by means of the tensions acting on the strip moving through them. The tension necessary to move the interconnected trolleys or tables is produced by means of the strip drives.

The invention starts from the knowledge that the friction resulting from looping prevents the strip from slipping when the trolleys or tables are being moved. For example, starting from their initial position the interconnected trolleys move out when the speeds of the strip drives at the exit and entry are equal to one another but are greater than the speed of the strip drive disposed after the processing section. Also, the interconnected trolleys move in when the speed of the strip drive, disposed after the processing section, is greater than the speeds of the exit and entry strip drives. In such a case, for example, the entry and exit strip drives can stop for the strip to be severed or joined, or the entry and exit strip drives can run at the same speed as one another but slower than the strip drive disposed after the processing section. When the entry and exit strip drives are stationary, either the entry strip drive or the exit strip drive is responsible for tensioning the particular strip concerned, for the strip drives are preferably tension- or torque controlled. It also falls under the invention for the strip which is to be treated to pass through the processing section at a constant speed. In such a case, according to the invention, the entry and exit strip drives are speed-controlled drives. The strip drive disposed after the processing section can of course also operate as a speed-controlled drive.

Other features of importance to the invention will be listed hereinafter. In horizontal constructions, the two loop trolleys can have common running gear and form a unit. In vertical constructions the two tables are preferably combined to form a unit having top and bottom rolls and the unit is movable in the loop tower between a stationary top roll carrier and a stationary bottom roll carrier. If the trolleys or tables are arranged separately from one another for reasons of space, they are interconnected by way of cables or chains, with or without the interposition of deflecting rolls, or by way of connecting transmissions. Conveniently, so that the trolleys or tables can be moved into the required position for threading-up the strips to be treated and for servicing and repair work, a low-power independent drive is associated with the interconnected loop trolleys or roll tables. This drive can be, for example, a capstan or winch or chain drive or the like.

A principle advantage provided by the invention is the provision of a strip store which is of very simple and operationally satisfactory construction due to omission of the conventional drives for the loop trolleys or roll tables, the drive being instead by way of the strip drives. Depending upon the number of loops and the value of the specific strip tension, the pulley block effect leads to tensions of 30 tons or more arising in the trolley or table, such tensions balancing one another. Omission of the conventional drives saves considerable expense and space, and easier servicing and repairing of the conventional drives. The strip store according to the invention can be used to join up discrete strip lines to form a total line; for example, for a strip pickling plant, plus reducing rolling mill, plus heat treatment, plus finishing and straightening line and plus parting-off line. The strip store according to the invention is interposed for each connection so that fault times or inspection times can be bridged without stoppage of the complete line.

The invention also provides a strip treatment apparatus with two entry and exit loop trolleys or loop tables which can move apart from one another by a predetermined amount and the resulting strip tensions can be supervised or limited.

According to another feature of the invention, the coupling between the two loop trolleys or roll tables is an independently driven return device yielding selectively to tension. A return device of this kind enables the interconnected trolleys to be moved independently of one another, and thus permits relative movements between them. For instance, the two trolleys are moved apart from one another as a result of tensions operative at the entry or exit, while the return device ensures that the two trolleys move towards one another to return to their original coupled together spacing after the required operations have been carried out in the strip-joining station. Similar considerations apply when interconnected roll tables are used.

In a preferred embodiment of the invention which is significant on its own, the return device is a double-acting reciprocating actuator and is pressurized in accordance with loop trolley tension, the actuator cylinder being connected to one loop trolley and the actuator piston or its rod being connected to the other loop trolley. In this connection the invention starts from the knowledge that the stroke of a reciprocating actuator is sufficient to move the two trolleys far enough away from and towards another, and independently of on another, for various operations to be performed. After the operation has been performed the reciprocator or its piston rod, pressurized by the trolley tension, retracts completely to restore the original between-tables spacing. Since the strip stores are normally stores storing four or six layers, a stroke of, for example, 2 m leads to the entry or exit trolley being movable by $2\times4=8$ m and $2\times6=12$ m respectively. This amount is completely satisfactory for any servicing and repair work which has to be carried out. Conveniently, supply lines which extend to a pump are connected to the two cylinder chambers on either side of the piston by way of at least one proportional valve for pressurization and flow direction. To this extent a hydraulic cylinder is used but theoretically a compressed air cylinder can be used. In any case, the return device or actuator arrangement can be so devised under the invention that only limited forces can arise. A simple way of ensuring this when a reciprocating actuator is used is for a relief valve to be associated with the corresponding cylinder chamber. Also, the cylinder can have a stroke measuring device, which, in normal operation, synchronizes the Speedmaster drives at the entry and exit. For example, when the entry and exit drives move back the entry can be moved back by an amount corresponding to the piston stroke multiplied by the number of layers or strands of strip, the pressure being maintained in the cylinder continuously. The cylinder experiences nothing but tension and never experiences bending stress. The cylinder can be continuously pressurized by the low capacity pump disposed. For example, on the trolley and thus control the tension between the entry and the exit. The pulley block effect is cancelled. For dynamic forces the cylinder, which is normally substantially completely retracted, acts as a variable-characteristic vibration damper on the relief valve.

In another embodiment which has independent significance, the return device is a cable winch or capstan or the like having a motor and brake, the winch being secured to one loop trolley and the cable either being secured to the other loop trolley or being returned to and secured to the winch receiving trolley by way of at least one deflecting roller. In this case, the brake can be used to produce a controlled movement of the two trolleys apart from one another in response to tensions operative at the entry or exit. The winch-driving motor is responsible for the return, i.e. the movement towards one another, i.e. of the two trolleys to the original coupling spacing. The guidance or deflection of the cable on the other trolley can always be such that the return forces are exerted in a relatively uniform distribution.

Another possibility is for the return device to be embodied as a rack drive. In the case in which a winch or a rack drive is the return device, a tension-limiting device just like the brake or the like for the winch can be provided in addition to the independent backwards movement.

The main advantages provided by the invention are that the strip treatment apparatus is so developed that, for example, for installation or repair or joining operations, the two trolleys or roll stores can be moved apart from one another by a predetermined amount so that in the case of the coupled store according to the invention the entry and exit do not have to move forwards or backwards at the same speed for these operations to be performed. Also, the return device is a reciprocating actuator supplied wit hydraulic medium by a pump. Overload protection can be provided by the interposition of a pressure relief valve.

Accordingly, it is an object of the invention to provide a strip drive for advancing materials for processing which includes an entrance or entry end having an entrance strip supply, an exit end spaced from the entrance end and having a strip take-up with guide means for the strip between the entrance end and the exit end which defines a strip movement path therebetween with a processing section along the path and with a store for the strip material in the path on each side of the processing section, each store having at least one interconnected roll tower with a vertically movable roll take-up table and/or a horizontally movable loop trolley or trolleys and including a strip drive adjacent the entry end and the exit end which are operative as drives for the loop trolley or the roll take-up table.

A further object of the invention is to provide a strip drive which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
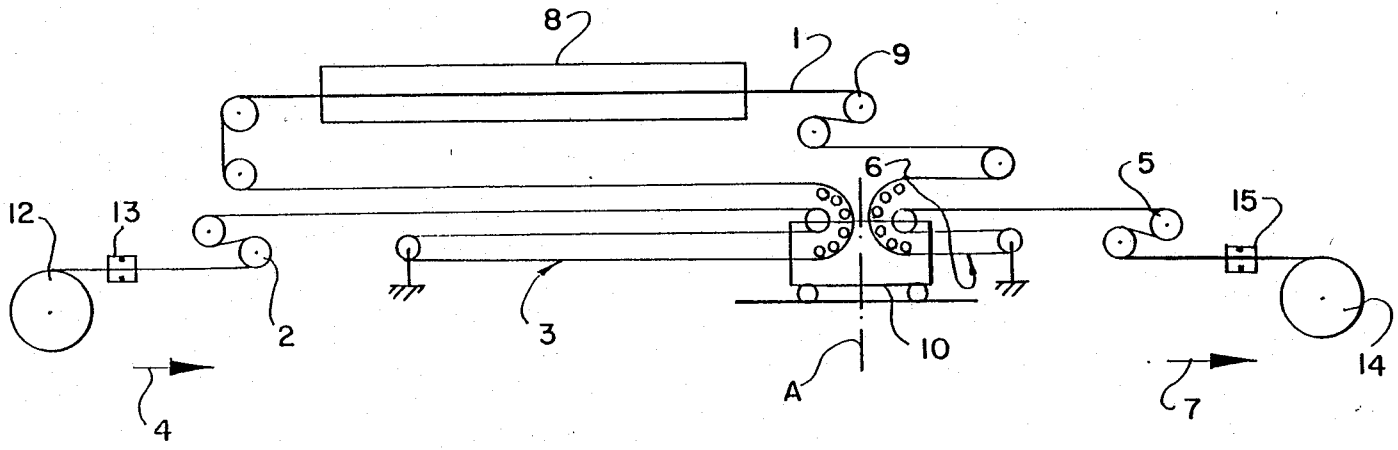
FIG. 1 is a diagrammatic view in side elevation of a strip treatment apparatus according to the invention with loop trolleys for the strip store.
Figure 2:
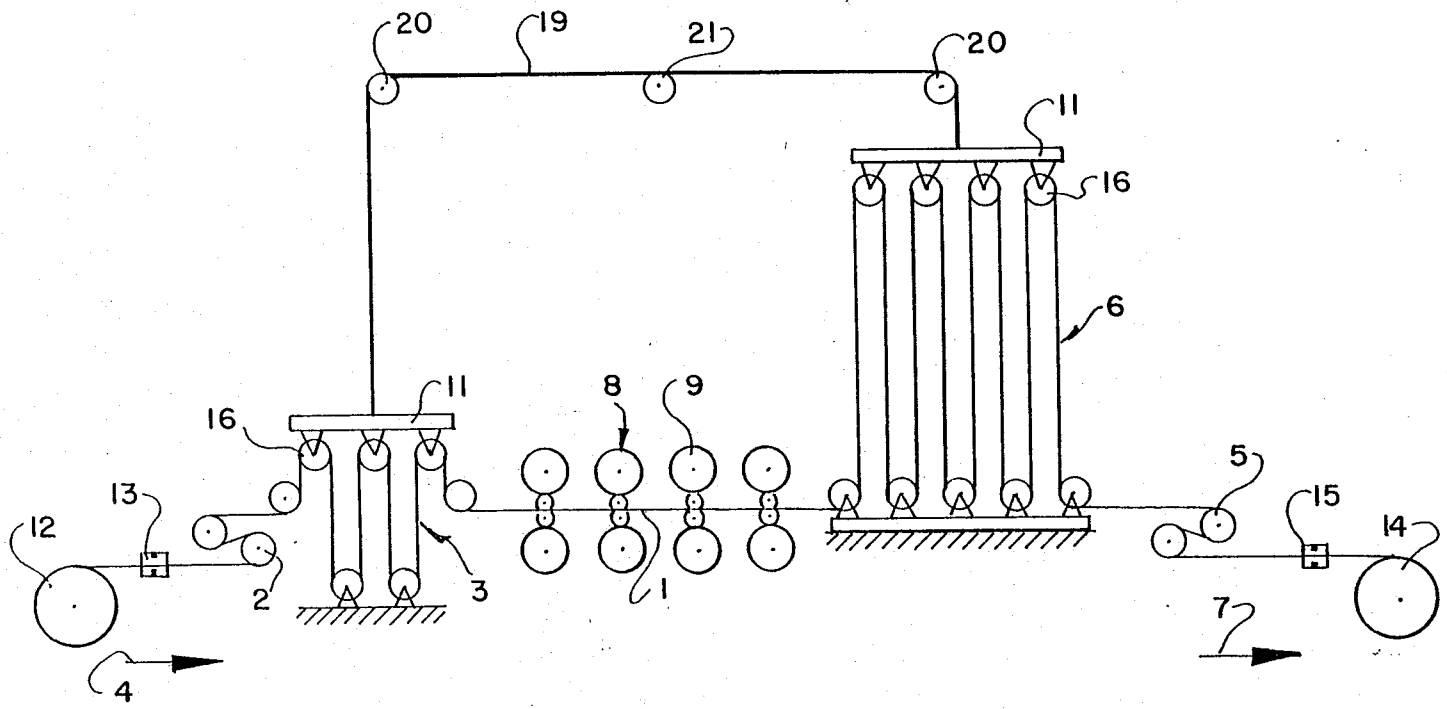
FIG. 2 is a similar view of a strip treatment apparatus according to the invention with roll tables for the strip stores.
Figure 3:
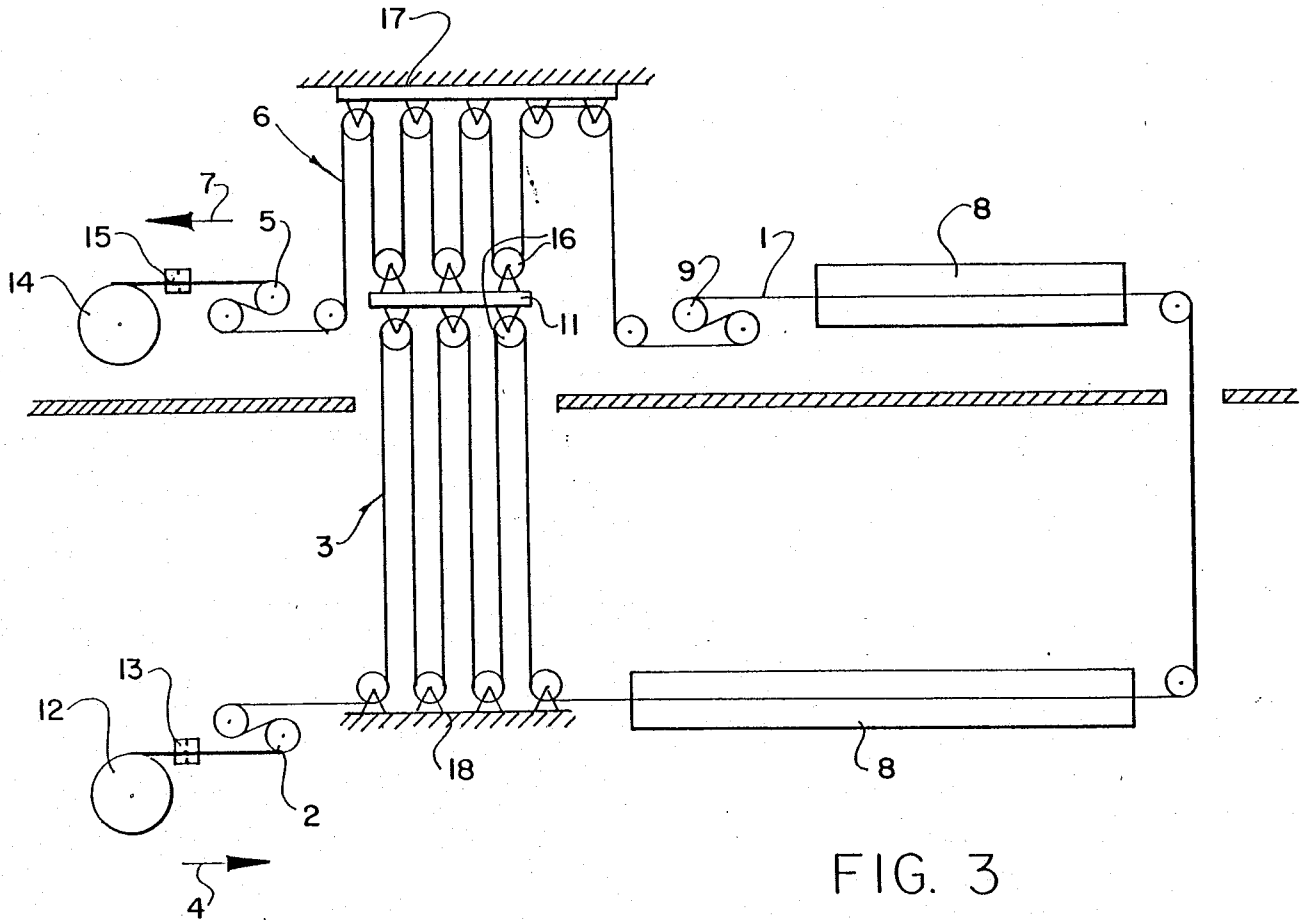
FIG. 3 is a view similar to FIG. 2 of another embodiment of the invention.

Referring to the drawings in particular the invention as embodied therein in FIG. 1 comprises a strip drive for advancing materials for processing through a processing section 8 and which includes an entry end 4 which has an entrance strip supply from a reel 12 an exit end 7 which is spaced from the entrance end and has a strip take-up roll 14. Guide means in the form of rollers are arranged for the strip between the entrance and exit ends and they define a strip movement path between the entrance and exit ends which includes the processing section 8. In accordance with the invention a store such as the store 6 indicated in FIG. 1 and/or the store 6 shown in FIG. 3 is arranged in the strip path on each side of the processing section 8. Each store has at least one interconnected roll tower such as indicated in FIG. 3 with a vertically movable interconnected roll take-up table 11 and/or at least one horizontally movable loop trolley such as the two trolleys which are used in the embodiment of FIG. 1 and designated 10.

FIGS. 1 to 4 show an apparatus for treating metal strips 1 or plastics strips or paper strips or the like, the apparatus basically comprising a strip drive 2 and strip store 3 at its entry 4 and a strip drive 5 and a strip store 6 at its exit 7. A processing section 8 is present between the two stores 3 and 6 and is followed by a strip drive 9. If the section 8 is a rolling mill the mill is operated by the drive 9. The stores 3 and 6 each comprise either a horizontally movable loop trolley 10 or a roll table 11, the latter being movable vertically in the loop tower. Also, at least one strip dispenser or roll supply 12 and, as a rule, a strip-joining station 13 are provided at the entry 4 and a take-up reel 14 and a parting-off station 15 are provided at the exit 7. Also, a number of processing stations 8 can be provided between the entry 4 and the exit 7.

The trolleys 10 and/or the two tables 11 are, independently of the strip looping through them, such strip being a metal strip 1 in the embodiment, mechanically interconnected to form a mobile unit. The drive 9 disposed after the processing section 8 and the drive formed thereby and/or the drives 2, 5 at the entry 4 and exit 7 are effective as a drive to move the interconnected trolleys 10 or tables 11. The drives 2, 5 and/or the drive 9 and the drive formed by a section 8 are speed-controlled drives.

The trolley unit 10 forms in effect a two trolley unit with common running gear. In one embodiment the two tables 11 are combined to form a unit 11 having top and bottom rolls 16. The unit 11 is movable in the loop tower between a top fixed roll carrier 17 and a bottom fixed roll carrier 18.

If the discrete trolleys !0 or tables 11 are physically separate from one another, they are interconnected by way of cables 19 or chains, with or without the interposition of deflecting rolls 20, or by way of connecting transmissions. Each trolley 10, 10*a* or table can have a low-power independent drive 21.

Figure 5:
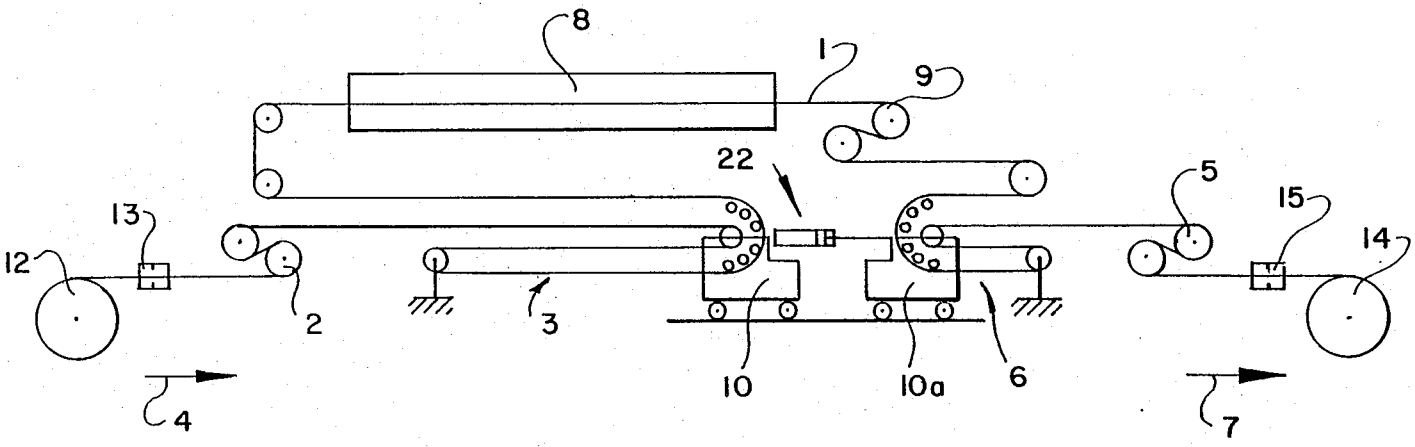
FIG. 5 is a view in diagrammatic side elevation of a further embodiment of strip treatment apparatus having coupled-together loop trolleys for the band store.

As can be directly gathered from FIGS. 1 and 5, the interconnected trolleys 10 (schematically shown in FIG. 1) are moved away from another from their initial position A by tensions acting on them when the drive speed of the exit drive 5 and the drive speed of the entry drive 2 are greater than the drive speed of the drive 9 after the section 8 and equal to another, for in this case the exit drive 5 pulls and removes from the exit side of the store 6 a longer length of strip than the drive 9 than the processing section 8 can convey. The entry drive 2, runs at the same speed as the exit drive 5 and thus conveys exactly the same length of strip as is taken from it by the exit drive 5. Conversely, the interconnected trolleys 10 move in towards one another when the speed of the drive 9 after the section 8 is greater than the speeds of the entry and exit drives 2 and 5. In this case the drive 9 after the section 9 exerts a pull. Thus the entry and exit drives 2, 5 can either stop or run at the same speed as one another, in which event the extra strip length required by the strip drive 9 disposed after the processing section 9 because of its higher speed is take from the store 3. When the strip is stationary in the entry 4 and exit 7 the metal strip in the entry 4 or exit 7 may be under tension, and so the trolley 10 moves in the direction of the tension or pull. If a continuous strip speed is required in the section 8, the drive 9 thereafter always operates at a constant speed whereas the entry drive 2 and the exit drive 5 are tension-controlled. A continuous strip speed in the section 8 is necessary, for example, when the rolled strip material is required to have uniform properties, for in such a case the form-changing speed or strength, lubricating conditions and other influences must remain constant. Similar considerations apply to the thermal camber of the rolls when the section 8 is a rolling mill. Also, the drives 2 and 5 are tension- or torque-controlled so that the strip tension necessary in various operative situations can be provided even when the drives 2 and 5 are either stationary or run at the same speed as one another but slower than the drive 9 after the section 8.

Referring to the embodiment shown in FIG. 3, due to the reduction in strip thickness and, therefore, increase in strip length at the exit 7 and the higher strip speed thereat than at the entry 4, the exit strip store 6 must be designed for a correspondingly increased storage capacity.

The drive 5 must also be designed for these speeds. Since the specific strip tension in the entry 4 and exit 7 can be maintained equal, identical forces arise in both loop towers. Conveniently, the exit strip store 6 should be designed in accordance with the maximum strip thickness reduction so far as the number of layers or strands of strip are concerned.

Figure 4:
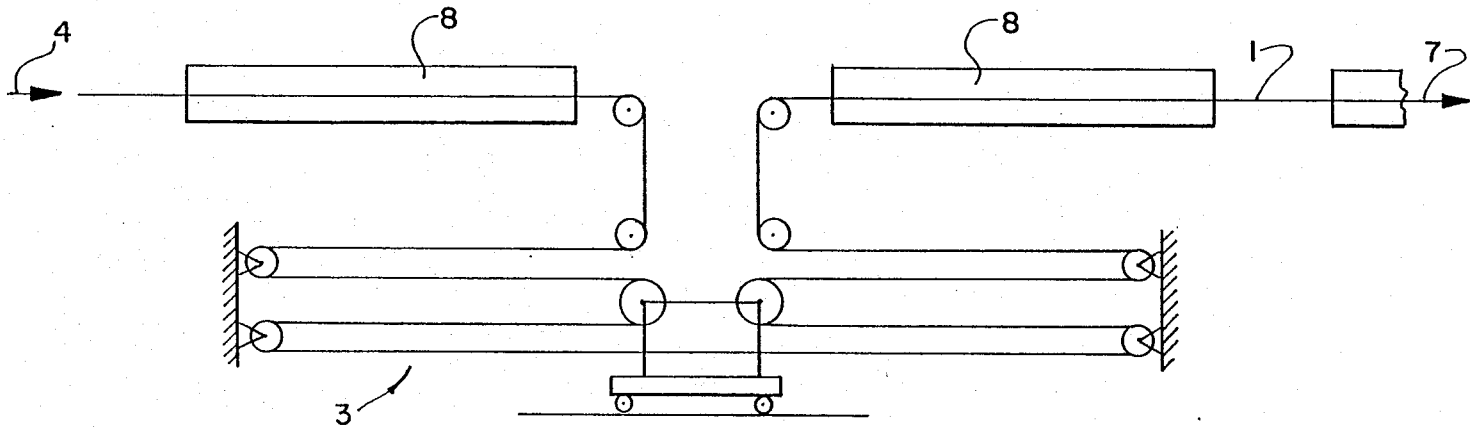
FIG. 4 is a view similar to FIG. 1 of a variant of the embodiment of FIG. 1, the variant having a number of processing sections.

In a variant of the invention shown in FIG. 4, a number of processing sections of a strip treatment 9 are disposed consecutively, for example, a digressing line, a coating line, a finishing stand for surface treatment etc. Brief disturbances, servicing work or the like can be bridged by means of the strip store according to the invention for several minutes so that strip continues to pass through the apparatus.

It also falls under the invention to combine strip stores having loop trolleys 10 on one side and a loop tower or movable roll table 11 on the other. Also according to the invention, in some operating conditions the strip drive 9 disposed after the processing section 8 can be entirely omitted.

FIGS. 5 to 8 show a further development of the strip treatment apparatus hereinbefore described. In this case the two trolleys 10 and 10*a* are mechanically interconnected to form a mobile unit independently of the strip looping through them, the strip being a metal strip 1 in the embodiment. The strip drive 9 which is either disposed after the processing section 8 or formed thereby and/or the entry drive 2 and exit drive 5 operate as drives to move the interconnected trolleys 10, 10*a*. The drives 2, 5 and/or 9 are speed-controlled drives.

The coupling between the two trolleys 10, 10*a* is in the form of an independently driven return device 22 which yields selectively under tension.

Figure 6:
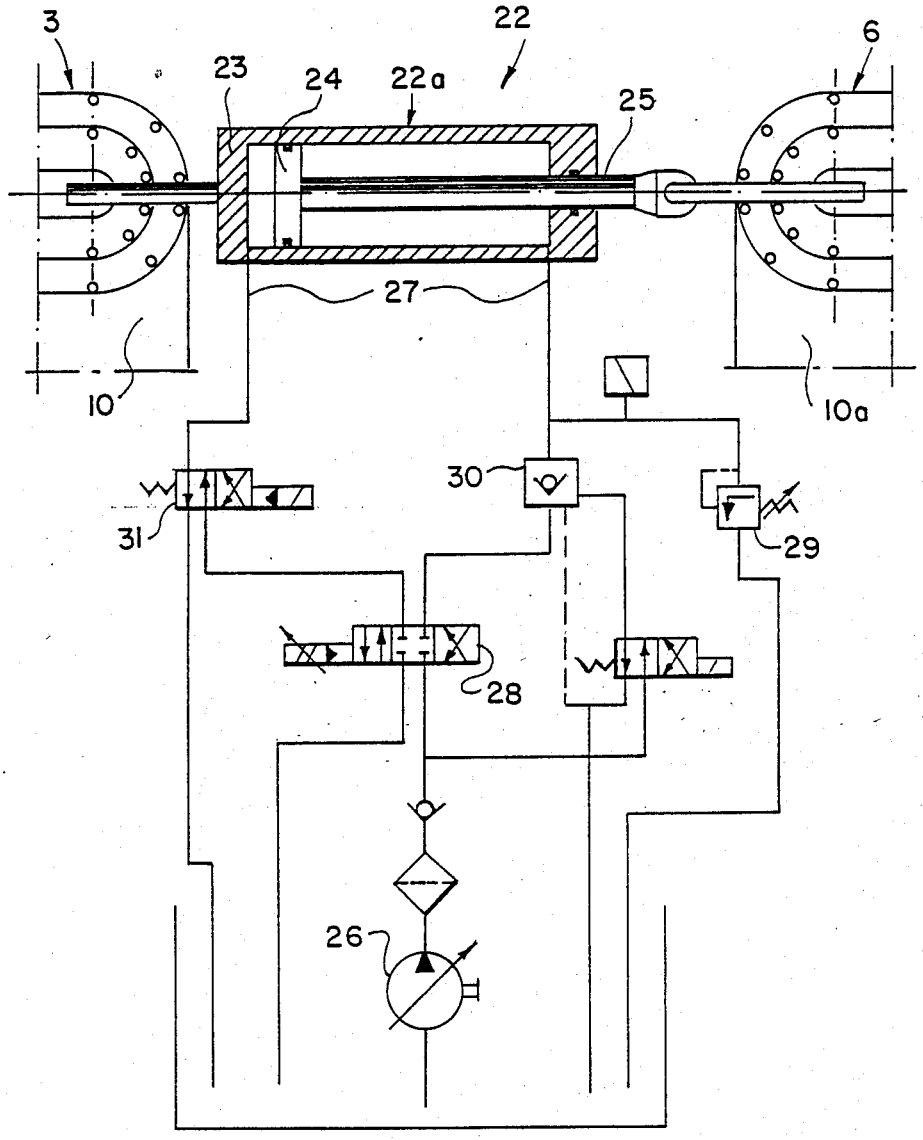
FIG. 6 is a view to an enlarged scale of part of the subject of another embodiment with a recovery device in the form of a reciprocating actuator arrangement.

Referring to FIG. 6, the return device is a double-acting cylinder and piston arrangement 22*a* and is pressurized in accordance with trolley tension, cylinder 23 being connected to one trolley 10 and piston 24 or its piston rod 25 being connected to the other trolley 10*a*. Supply lines 27 which extend to a hydraulic pump 26 are connected to the two cylinder chambers on either side of the piston 4 with the interposition of a proportional valve 28 for pressurizing and flow direction. Also, a pressure relief valve 29, a controlled check valve 30 and a multiple way valve 31, for counter-energization can be provided, for example, for installation and repair work. In any case, the arrangement is such that after the operation has been completed the piston rod 25 retracts completely so that the two trolleys 10, 10*a* move together to their original coupled-together spacing.

Figure 7:
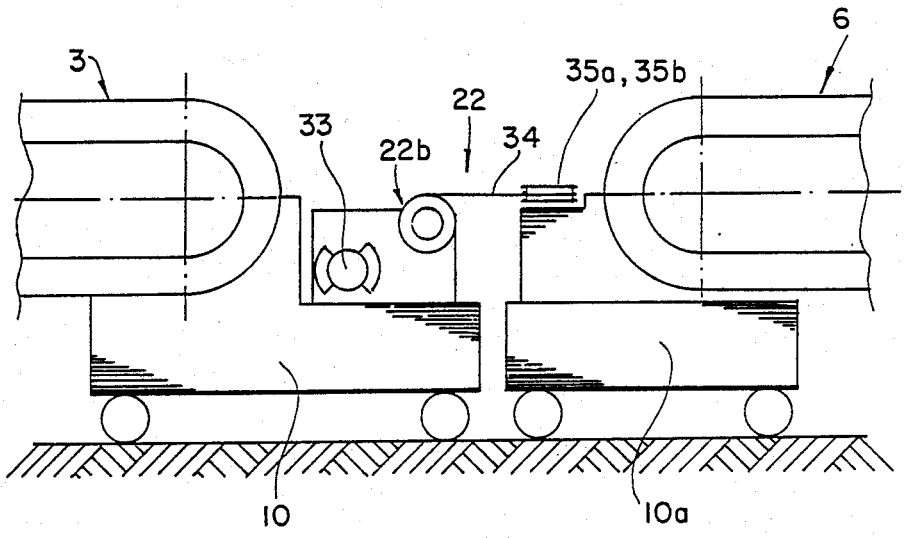
FIG. 7 is a view to an enlarged scale of part of FIG. 5 with a return device in the form of a cable winch.
Figure 8:
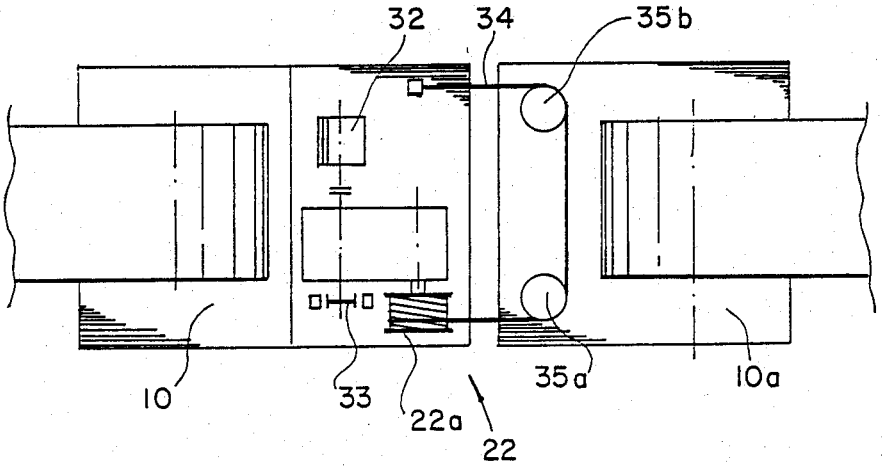
FIG. 8 is a plan view of the device shown in FIG. 7.

In the embodiment shown in FIGS. 7 and 8, the return device is a cable winch 22*b* having a motor 32 and a brake 33, the winch 22 being disposed on one trolley 10 while the cable 34 is either secured to the other trolley 10*a* or returned, by way of deflecting rolls 35*a*, 35*b* in a U-shaped path, to the winch-receiving trolley 10 and secured thereto.

While specific embodiments of the invention have been shown and described in detail to illustrate the application of the principles of the invention, it will be understood that the invention may be embodied otherwise without departing from such principles.

What is claimed is:

1. An apparatus for treating strips of material such as metal, plastics, paper and the like comprising a strip drive having an entry end and an exit end, a strip store disposed at said entry end and said exit end, a processing section being disposed between two stores, a strip drive unit disposed after said processing section, each strip store comprising a horizontally movable loop trolley, means mechanically interconnecting said loop trolleys independently of the strip to form a horizontally movable unit, a strip drive unit being located at said entry end and said exit end and being operative as drives for moving the interconnected loop trolleys, said strip drive units being one of speed controlled drives and torque controlled drives.

2. An apparatus according to claim 1, wherein the two, interconnected loop trolleys have common running gear.

3. An apparatus according to claim 1, wherein there the means interconnecting said loop trolleys permits movement thereof toward and away from each other.

4. An apparatus according to claim 1, wherein the means interconnecting the loop trolleys includes an independent drive unit.

5. An apparatus according to claim 1, wherein the loop trolleys are movable toward and away from each other and comprising an independent drive unit for driving said two loop trolleys yielding selectively to the tension between them.

6. A strip drive for advancing materials for processing, comprising an entry end having an entrance strip supply and an exit end spaced from said entry end and having a strip take-up, guide means for the strip between said entry end and said exit ends defining a strip movement path therebetween, a processing section along said path, a store for the strip in said path on each side of said processing section, each store having a horizontally movable loop trolley, means mechanically interconnecting the two loop trolleys independently of the strip to form a horizontally movable unit, and a strip drive unit adjacent said entry and said exit end which are operative as drives for said loop trolley unit.

7. A strip drive according to claim 6, including a separate drive unit for driving said trolley, one of said drive units being after said processing section and being one of a speed control drive and a torque-control drive.

8. An apparatus to claim 6, wherein the two, interconnected loop trolleys having a common running gear.

9. An apparatus according to claim 6, wherein the means interconnecting said loop trolleys permits movement thereof toward and away from each other.

10. An apparatus according to claim 6, wherein the means interconnecting the loop trolleys includes an independent drive unit.

11. An apparatus according to claim 6, wherein the loop trolleys are movable toward and away from each other and comprising an independent drive unit for driving said two loop trolleys yielding selectively to the tension between them.

12. An apparatus according to claim 11, in which the drive unit includes a double acting reciprocating actuator between said two loop trolleys, said actuator including a cylinder with a piston movable in said cylinder, said cylinder being connected to one of said trolleys and said piston being connected to the other of said trolleys.

13. An apparatus according to claim 12, including a supply line having a pump connected thereto and connected to said cylinder, said cylinder having two separate changes connected to said pump supply line a proportional valve in the connection for pressurizing and relieving pressure on respective sides of said piston.

14. An apparatus according to claim 6, wherein the means interconnecting the loop trolleys includes a cable winch and a motor driving said winch for bringing said trolleys together selectively.

15. A strip device according to claim 6, wherein the means interconnecting the loop trolleys includes a return device comprising a rack drive.

16. An apparatus for treating strips of material such as metal, plastics, paper and the like comprising a strip drive having an entry end and an exit end, a strip store disposed at said entry end and said exit end, a processing section being disposed between two stores, a strip drive unit disposed after said processing section, each strip store comprising a roll table movable vertically in a loop tower; means mechanically interconnecting said roll tables independently of the strip to form a movable unit, a strip drive unit being located at said entry end and said exit end and being operative as drives for moving the interconnected roll tables, said strip drive units being one of speed controlled drives and torque controlled drives.

17. An apparatus according to claim 16, wherein tower the two tables are combined to form a unit having a top and bottom roll, the combined tables being movable in a loop tower between a stationary top roll carrier and a stationary bottom roll carrier.

18. An apparatus according to claim 16, wherein the means interconnecting said roll table includes an independent drive unit.

19. A strip drive for advancing materials for processing, comprising an entry end having an entrance strip supply and an exit end spaced from said entry end and having a strip take-up, guide means for the strip between said entry end and said exit ends defining a strip movement path therebetween, a processing section along said path, a store for the strip in said path on each side of said processing section, each store having an interconnected roll tower with a vertically movable interconnected roll take-up table, means mechanically interconnecting the two roll tables independently of the strip to form a movable unit, and a strip drive unit adjacent said entry and said exit end which are operative as drives for said roll table.

20. An apparatus according to claim 19, wherein the two tables are combined to form a unit having a top and bottom roll, the combined tables being movable in a loop tower between a stationary top roll carrier and a stationary bottom roll carrier.

* * * * *